United States Patent [19]

Kotlar

[11] 4,081,972

[45] Apr. 4, 1978

[54] PENDANT, EARRING OR PIECE OF JEWELRY

[76] Inventor: Daniel Kotlar, 50 Charles St., New Rochelle, N.Y. 10801

[21] Appl. No.: 691,993

[22] Filed: Jun. 2, 1976

[51] Int. Cl.[2] ..... A44C 17/00

[52] U.S. Cl. ..... 63/31; 46/193; 428/11

[58] Field of Search ..... 63/31, 23; 46/24, 193; 428/11, 542; 144/309 A, 309 R, 322, 326 R; 272/8 N; 29/160.6, 412, 416; 408/71

[56] References Cited

U.S. PATENT DOCUMENTS

| | | | |
|---|---|---|---|
| D. 234,790 | 4/1975 | Rosenberg | 46/193 X |
| 2,211,102 | 8/1940 | Davis | 46/193 |
| 2,222,571 | 11/1940 | Osborne | 428/11 |
| 2,258,413 | 10/1941 | Koven | 63/31 |
| 3,841,782 | 10/1974 | Mengeringhausen | 408/71 |

*Primary Examiner*—F. Barry Shay
*Attorney, Agent, or Firm*—Ernest G. Montague

[57] ABSTRACT

A pendant, earring, jewelry piece or the like which comprises an outside cage-like casing which is equipped with a plurality of openings provided on the peripheral faces thereof and an inside body disposed inside of the outside casing and of a dimension larger than said openings in the outside casing. The outside casing has a configuration of a cube or a cube-like member and the inside body is freely movable in the outside casing and has the configuration of a ball, a cube or any other convenient shape. The inside body may also be hollow and may receive another still smaller inside body freely movable therein.

3 Claims, 14 Drawing Figures

PENDANT, EARRING OR PIECE OF JEWELRY

The present invention relates to a pendant, an earring, a piece of jewelry, or the like and which comprises an outside cage-like casing and the inside of which has inserted therein one or more movable parts as for instance likewise a cage-like casing of smaller dimensions than those of the outside casing. The outside cage-like casing has a plurality of openings and the inside casing or body is movable in the hollow cage-like outside casing and can be formed as a ball, a cube or any other suitable shape. The openings in the outside cage-like casing are of a size and of such dimensions that the inside body cannot escape from the outside cage-like casing through such openings and is rather retained therein, in spite of its free movement in the outside casing.

It is one object of the present invention to provide an outside cage-like casing having a plurality of openings and an inside body of any suitable configuration is disposed inside of said outside casing thereby permitting movement of the inside body in said outside casing without possibility of escape of said body through such openings.

The inside body can be formed as a ball, a cube or even a plurality of cubes, whereby a smaller body is contained in a slightly larger body, yet samll enough to be retained in the outside cage-like casing.

In is another object of the present invention to provide a pendant, an earring, a piece of jewelry, or the like in which the outside cage-like casing is formed as a cube or as any suitable hollow body receiving an inner body which is movable in the outside body, without permitting an escape of the inner body from the outside cage-like casing.

With these and other objects in view which will become apparent in the following detailed description, the present invention, which is shown by example only, will be clearly understood in connection with the accompanying drawings, in which:

FIG. 11 is an isometric view of the starting cube during manufacture of the pendant, earring or the like;

Figure 1:
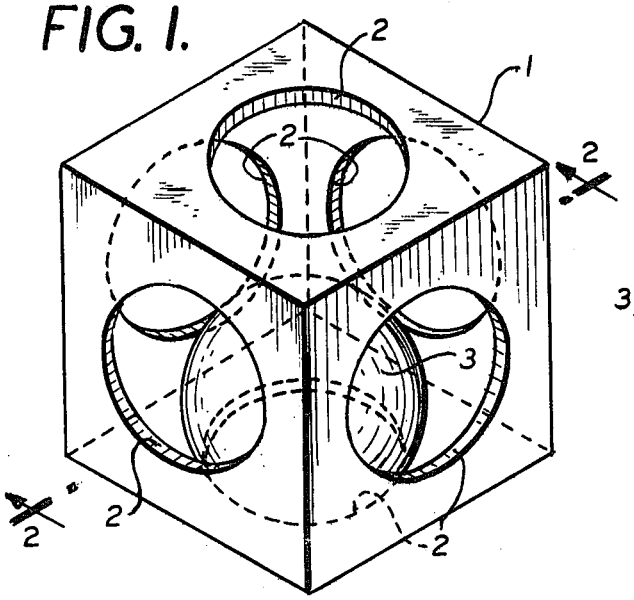
FIG. 1 is an isometric view of a first embodiment of the present invention.
Figure 2:
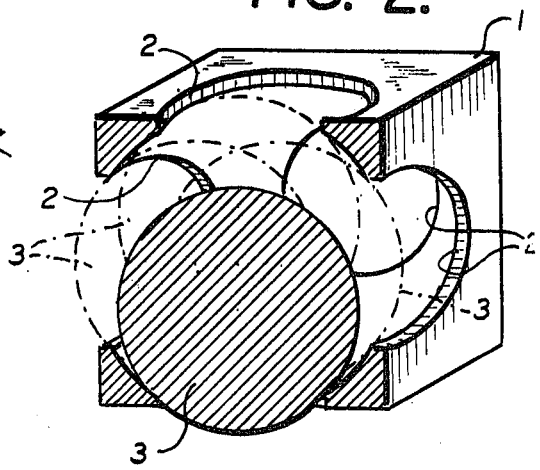
FIG. 2 is a section along the lines 2—2 of FIG. 1.

Referring now to the drawings, and in particular to FIGS. 1 and 2, a first embodiment of the pendant or earring is disclosed. The pendant, earring or piece of jewelry comprises an outside cage-like casing 1 formed as a cube which is hollow and has on each of its peripheral faces a circular opening 2. Inside of the hollow outside cube is disposed a ball-shaped body 3, which has a diameter larger than the diameter of the circular opening 2, so that the body 3 cannot escape through the circular openings 2 from the outside casing 1 and is only movable therein.

Figure 3:
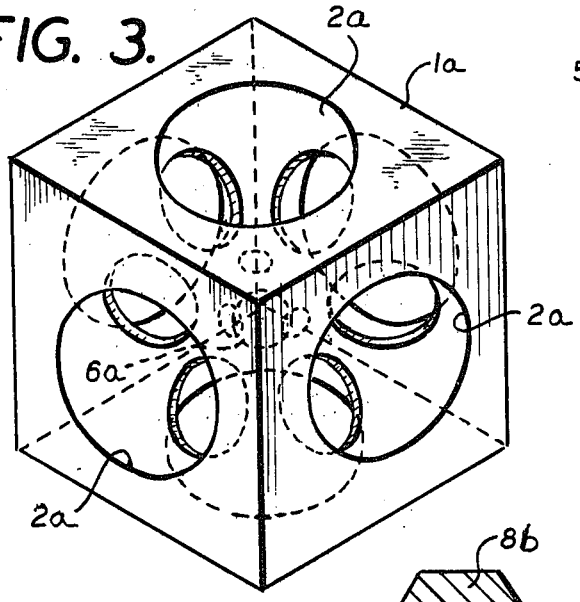
FIG. 3 is an isometric view of a second embodiment of the present invention.
Figure 4:
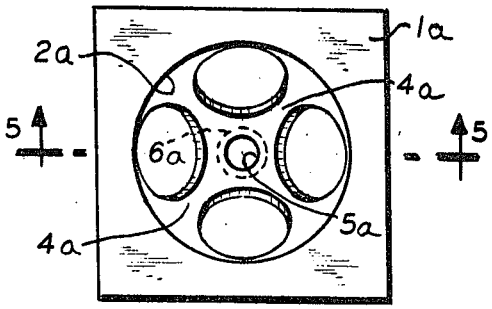
FIG. 4 is a plan view of the second embodiment shown in FIG. 3.
Figure 5:
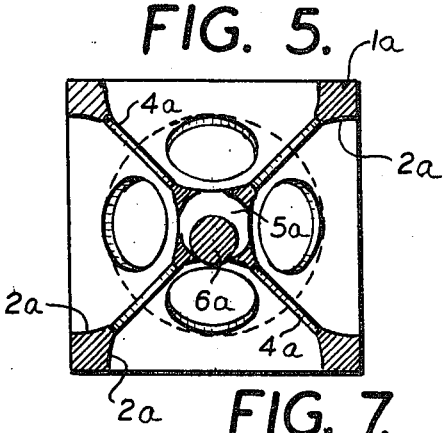
FIG. 5 is a section along the lines 5—5 of FIG. 4.

Referring now again to the drawings, and in particular to FIGS. 3–5, a second embodiment of the pendant, earring or piece of jewelry is disclosed, in which the outside cage-like casing 1*a* has, as shown in the first embodiment, in each of the six peripheral faces a circular opening 2*a*. A plurality of stays 4*a* extends from the corners of the cube or outside casing 1*a* towards the center of the cavity inside the cube or casing 1*a* to form an inner cage 5*a* for supporting a small inside ball 6*a* which is movable in the inner cage 5*a* and at the same time retained therein.

Figure 8:
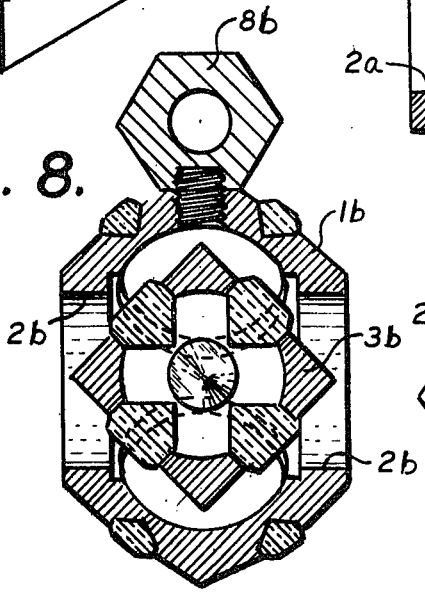
FIG. 8 is a section along the lines 8—8 of FIG. 7.
Figure 7:
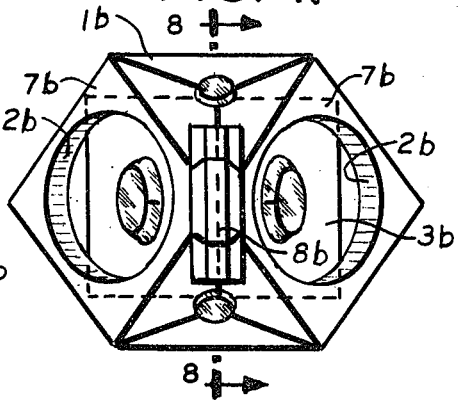
FIG. 7 is a plan view of the third embodiment of the present invention in Feb. 6.
Figure 6:
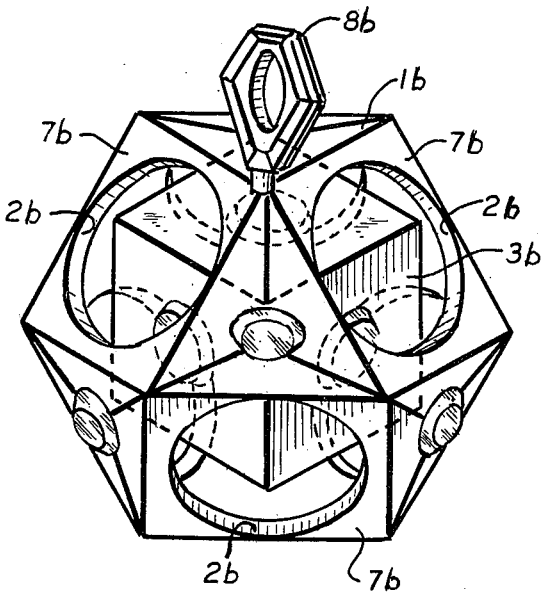
FIG. 6 is an isometric view of a third embodiment of the present invention.

Referring now again to the drawings, and in particular to FIGS. 6–8, a third embodiment of the pendant, earring or piece of jewelry is disclosed, in which the outside cage-like casing 1*b* is again of basically multi-faced configuration, yet as particularly clearly shown in FIG. 7 having the corners replaced by a flat cone-configuration and having inserted into the apex of the cone a synthetic, semi-precious or precious "stone". On each of the six straight peripheral faces 7*b* a circular opening 2*b* is provided. Inside of the cage-like outside casing 1*b* is disposed a smaller body 3*b*, which is formed in this embodiment of cube-shape. The inner body 3*b* has at each of its six peripheral faces likewise set in a synthetic, semi-precious or precious "stone". Finally an ear piece 8*b* is screwed into one of the corners of the outside casing 1*b* which ear piece 8*b* is adapted to receive a pendant chain (not shown). In case of use an an earring the ear piece 8*b* is replaced by an appropriate conventional member to be attached to the ear lobe. In case of use as a pendant a chain is threaded through the ear piece 8*b*.

Figure 9:
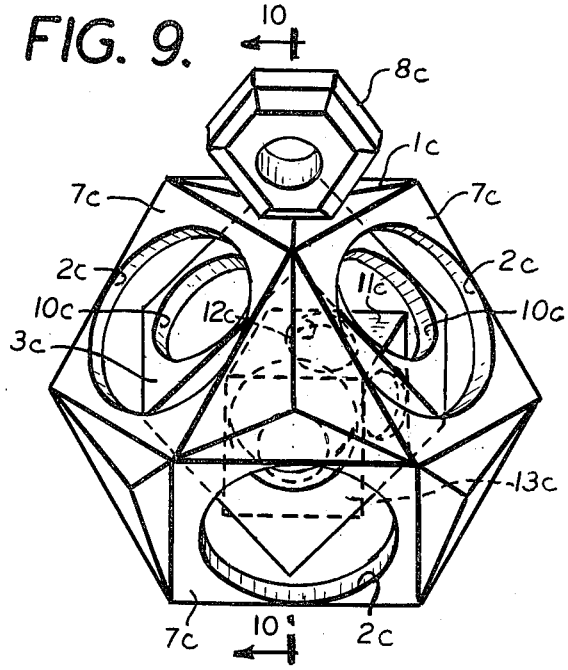
FIG. 9 is an isometric view of a fourth embodiment of the present invention.
Figure 10:
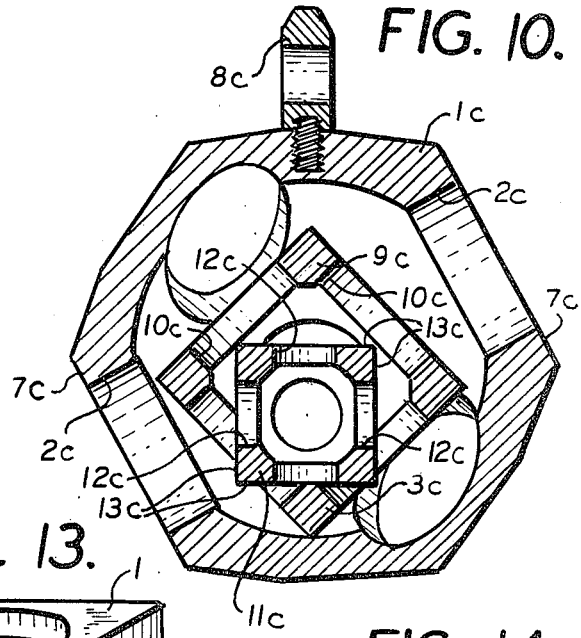
FIG. 10 is a section along the lines 10—10 of FIG. 9.
Figure 12:
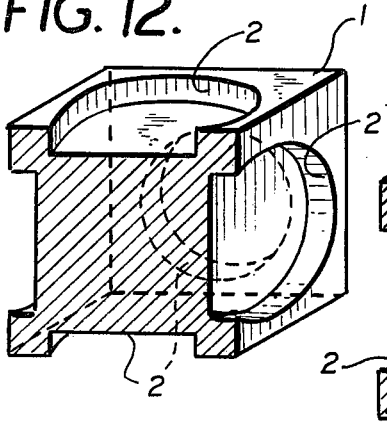
FIG. 12 is a section in an isometric view of the solid cube after a first drilling.
Figure 13:
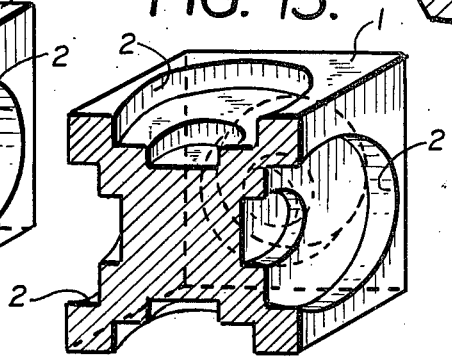
FIG. 13 is a section in an isometric view of the cube after the second drilling.
Figure 14:
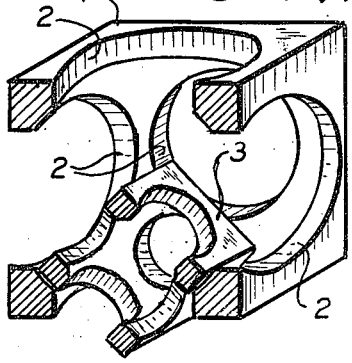
FIG. 14 is a section in an isometric view of a completed outside and inside cube.

Referring now again to the drawings, and in particular to FIGS. 9 and 10, a fourth embodiment is provided, in which the outside cage-like casing 1*c* is again, similar to the third embodiment, of basically multi-faced configuration. Yet again it has the corners replaced by a flat cone configuration. The outside cage-like casing 1*c* has on its peripheral faces 7*c* circular openings 2*c* and has in addition inside of the outer cage-like casing 1*c* a smaller inner body 3*c* which is formed here as a cube and has on its six peripheral faces 9*c* circular openings 10*c*. Inside of the mentioned first inner body is an innermost body likewise formed as a cube 11*c* which has also circular openings 12*c* on its six peripheral faces 13*c*. Finally, an ear piece 8*c* is also threadedly connected to the outside cage-like casing 1*c*.

The pendant or earring or piece of jewelry can be produced by different means, namely by standard or special intercasting or die casting practices, by using rubber molds or by applying screw machine type operations.

A preferred way of manufacture is disclosed in FIGS. 11–14 of the drawings.

Figure 11:
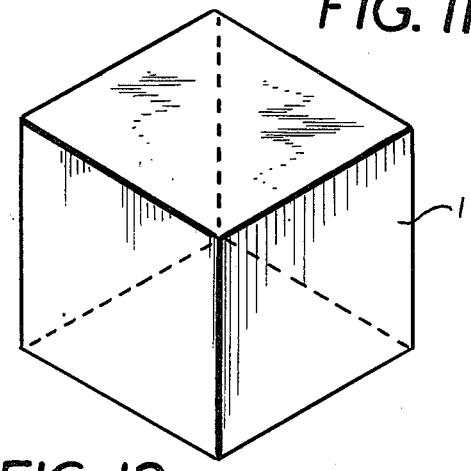

Referring to these particular drawings, FIG. 11 discloses an isometric view of a starting solid cube.

For illustration the manufacture of a cube disposed inside of an outside cage-like casing formed likewise as a cube is depicted. An opening is at first bored on each face of the outer cube to a predetermined diameter and depth. A boring bar-type tool enters into each individual bored hole and an undercut is machined. All that remains is a web of material connecting each internal corner. By lightly tapping into each bored hole, the web is fractured, thereby detaching the internal body from the external cube. Preferably the external cube is then chamfered and a tapped hole which receives an eyelet is machined into the outside cage. The described method permits to machine a cube within a cube and if required still a further smaller cube.

Other methods of producing the pendant, earring or piece of jewelry can be applied by splitting a cube in half and assembling a smaller cube within the split halves. The two halves can then be joined by various means such as glueing, doweling, soldering or the like.

While I have disclosed several embodiments of the present invention, it is to be understood that these embodiments are given by example only and not in a limiting sense.

I claim:

1. A piece of jewelry comprising a hollow multi-faced outside cage-like casing having a plurality of substantially circular openings in its peripheral surfaces, at least one body disposed inside of said outside cage-like casing, the dimensions of said body being larger than those of said circular openings, to prevent escape from said casing, and said body being freely movable within said outside cage-like casing, said outside casing being interiorly solid prior to rendering it cage-like, and said body being formed out of said solid interior and then separated from said casing.

2. The piece of jewelry, as set forth in claim 1, wherein said outside cage-like casing comprises a cube having six peripheral faces, and one of said circular openings being disposed in each of said peripheral faces of said cube.

3. The piece of jewelry, as set forth in claim 1, wherein said body comprises a solid ball of a diameter larger than that of said circular openings.

* * * * *